United States Patent [19]

Miura

[11] Patent Number: 4,643,749

[45] Date of Patent: Feb. 17, 1987

[54] CERAMIC FILTERS

[75] Inventor: Yasunao Miura, Kasugai, Japan

[73] Assignee: Nippondenso Co., Ltd., Kariya, Japan

[21] Appl. No.: 742,391

[22] Filed: Jun. 7, 1985

[30] Foreign Application Priority Data

Jun. 12, 1984 [JP] Japan ..... 59-121231

[51] Int. Cl.[4] ..... B01D 39/20

[52] U.S. Cl. ..... 55/523; 55/DIG. 30; 422/180; 428/116

[58] Field of Search ..... 55/523, DIG. 30; 210/510.1; 422/180; 428/116–118; 502/439; 60/311

[56] References Cited

U.S. PATENT DOCUMENTS 4,329,162 5/1982 Pitcher, Jr. ..... 55/523
4,364,761 12/1982 Berg et al. ..... 55/523
4,416,676 11/1983 Montierth ..... 55/523
4,417,908 11/1983 Pitcher, Jr. ..... 55/523
4,420,316 12/1983 Frost et al. ..... 55/523
4,428,758 1/1984 Montierth ..... 55/523

*Primary Examiner*—David L. Lacey
*Attorney, Agent, or Firm*—Cushman, Darby & Cushman

[57] ABSTRACT

A ceramic filter for collecting Diesel exhaust particulates has a plurality of interlaced porous internal walls defining a plurality of axial inlet passages extending adjacent to a plurality of axial outlet passages. Each of the internal walls has a three dimensional porous ceramic network structure to permit gases to flow from an adjacent inlet passage through the pores in the wall to an adjacent outlet passage. The cross-sectional configurations of the inlet and outlet passages is determined to assure that each of the internal walls has a wall thickness which varies widthwise of the wall. The wall thickness is minimum in the central zone of the width of each of the walls and is increased toward the lateral sides of the width of each of the walls.

3 Claims, 17 Drawing Figures

CERAMIC FILTERS

FIELD OF THE INVENTION

The present invention relates to ceramic filters for collecting carbon particles such as Diesel exhaust particulates.

DESCRIPTION OF THE PRIOR ART

The most important things required for these kind of filters are to collect Diesel exhaust particulates at a high efficiency and to minimize the increase with time of resistance to flow of exhaust gases therethrough. In an attempt to satisfy the requirements for the high particulate collecting efficiency and the minimized pressure loss, there have been proposed two types of ceramic filters, one of which is foam type and the other of which is honeycomb type. The foam type can provide a low pressure loss but fails to provide a high particulate collecting efficiency, while the honeycomb type provides a high particulate collecting efficiency but fails to provide a low pressure loss. Thus, any of the two types of ceramic filters is in short of satisfying the two requirements at the same time.

SUMMARY OF THE INVENTION

It is an object of the present invention to provide a ceramic filter which provides both a high particulate collecting efficiency and a low pressure loss.

According to the present invention, there is provided a filter element of the type that comprises a ceramic monolith honeycomb structure having a plurality of interlaced porous internal walls defining a plurality of substantially parallel inlet passages extending adjacent to a plurality of substantially parallel outlet passages, each of the internal walls having pores to permit gases to flow from an adjacent inlet passage through the pores in the wall to an adjacent outlet passage. The filter element according to the present invention is characterized in that each of the internal walls has a thickness which varies widthwise of the wall and that the wall thickness is minimum in the central zone of the width of the wall and increases toward the lateral sides of the width of the wall.

The invention will be described by way of example with reference to the accompanying drawings.

DESCRIPTION OF THE PREFERRED EMBODIMENTS

Figure 1:
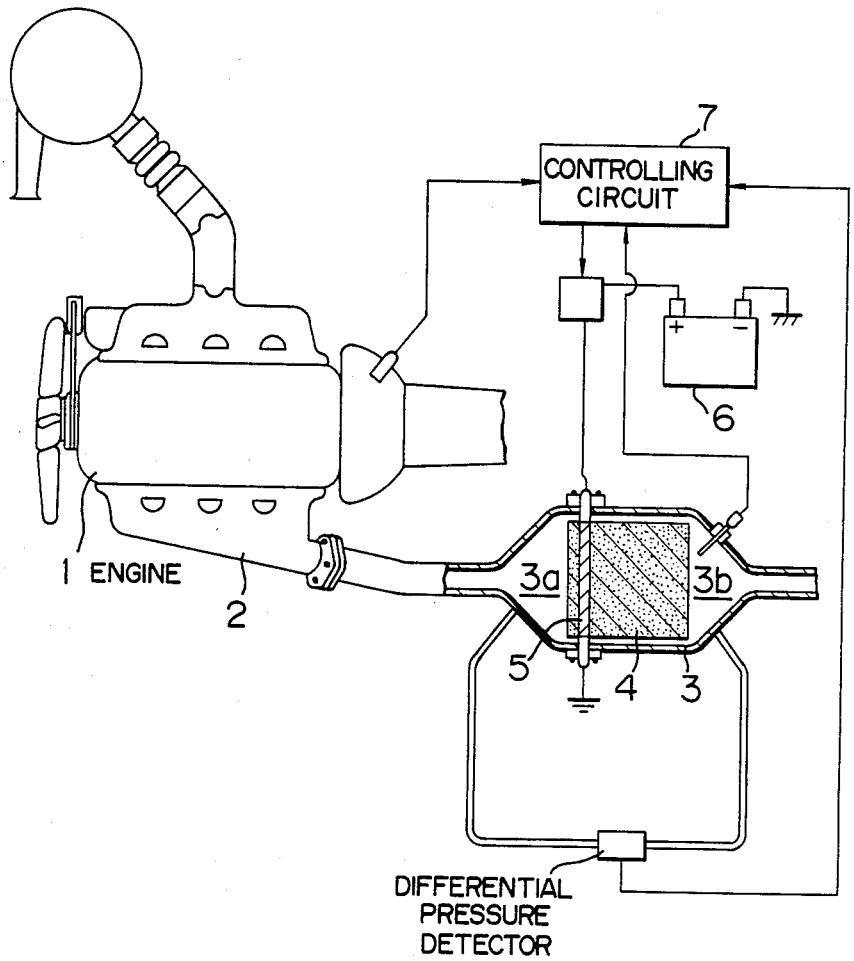
FIG. 1 is a schematic illustration of a Diesel exhaust system in which a ceramic filter according to the present invention is incorporated.

Referring to FIG. 1, a Diesel engine 1 has an exhaust gas collecting pipe 2 having downstream end connected with a hollow metallic container 3 accommodating a Diesel exhaust particulate ceramic filter 4 provided with an electric heater 5. The container 3 and the filter 4 cooperate to define a gas inlet space 3*a* and a gas outlet space 3*b*. The heater 5 is disposed adjacent to the upstream end of the filter 4 and electrically connected to a battery 6 so that the heater can be electrically energized to incinerate carbon particles deposited on the ceramic filter 4. The electrical supply from the battery 6 to the heater 5 is controlled by a controlling circuit 7 in accordance with various parameters such as pressure loss across the filter 4, fuel consumption rate and length of distance over which a vehicle equipped with the engine has been operated.

Exhaust gases from the Diesel engine flow into the container 3 and thus into the filter 4 so that Diesel exhaust particulates are removed by the filter 4 and cleaned gases pass through the filter and are discharged from the container 3.

Referring to FIGS. 2 through 5, the filter 4 comprises a ceramic honeycomb structure having a substantially cylindrical outer profile and a plurality of thin interlaced porous internal walls 12 defining a plurality of substantially axially extending parallel passages 13 and 15. The passages 13 are closed at the downstream ends so that they act as inlet passages, while the passages 15 are closed at the upstream ends so that they act as outlet passages. Each of the porous internal walls 12 is of a three dimensional porous network structure formed by a ceramic material 11 and pores 14 formed therein. The porous network structure somewhat resembles a foamed open-cell structure. The pores 14 in each internal wall are communicated with each other so that, in operation, Diesel exhaust gases entering the inlet passages 13 pass through the porous internal walls 12 into the outlet passages 15.

Figure 2:
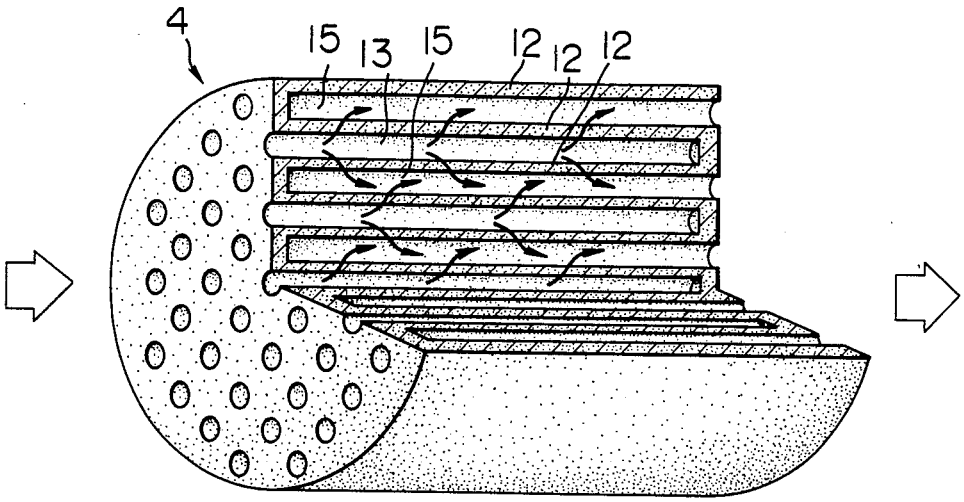
FIG. 2 is an enlarged perspective view of an embodiment of the ceramic filter according to the present invention with a part of the filter cut away to show the inner structure.
Figure 3:
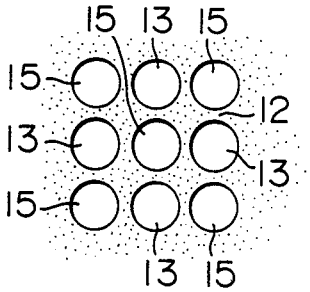
FIG. 3 schematically illustrates a combination of the cross-sectional shapes of inlet and outlet passages in the ceramic filter according to the present invention.
Figure 4:
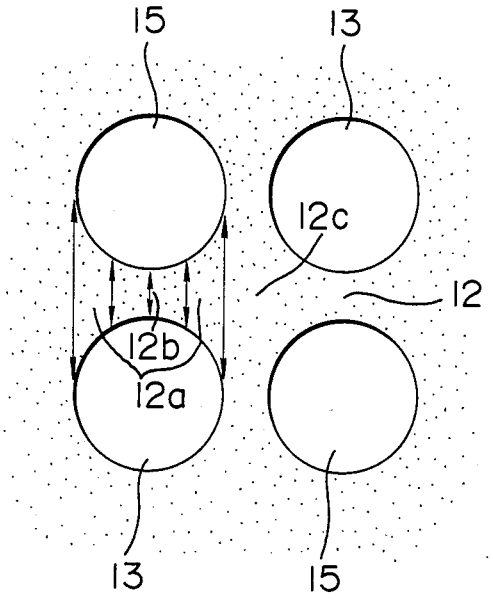
FIG. 4 illustrates in a larger scale only a part of the area shown in FIG. 3.
Figure 5:
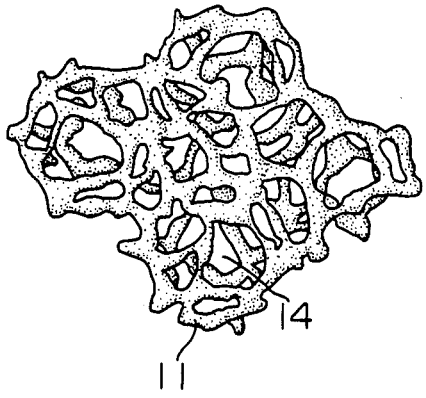
FIG. 5 schematically illustrates in a greatly enlarged scale the three dimensional network structure of a porous ceramic wall in the ceramic filter.

In the embodiment shown in FIGS. 2, 3 and 4, the inlet and outlet passages 13 and 15 are all of circular cross-section. Thus, the internal wall 12 between an inlet passage 13 and an adjacent outlet passage 15 has a varying or non-uniform wall thickness; namely, the wall 12 is thinnest in its central zone 12*b* where the inner peripheral surfaces of the two passages 13 and 15 are most closely spaced. The thickness of the wall 12 is gradually increased toward the opposite lateral or side zones 12*a*, as will be seen from the comparison of central short arrows with longer arrows on the opposite lateral sides of the shorter arrows in FIG. 4. The internal walls 12 are arranged in lattice pattern so that four walls 12 intersect at a point to form a cross or intersection 12*c*. The described internal wall structure is very important for the reasons to be made apparent by the following description.

It has been found through test researches that, in a ceramic filter of honeycomb type having interlaced internal walls each of a three dimensional porous ceramic network structure, carbon particles contained in Diesel exhaust gases are removed by the filter basically by a mechanism that the Diesel particulates impinge against the surfaces of porous ceramic network structures which form the internal walls (12). The Diesel particulates are thus adhered to and deposited on the surfaces of the ceramic network structures. However, after the operation of the filter for a long period of time, the pores (14) in the three dimensional ceramic network structure become completely filled with deposits of carbon particles. After this time, the carbon particle collecting mechanism is changed from the described particulate impingement function to a filtration function in which the carbon particulates are now collected by the inner peripheral surfaces of the inlet passages 13, or in other words, by the surfaces of the internal walls 12.

Figure 6:
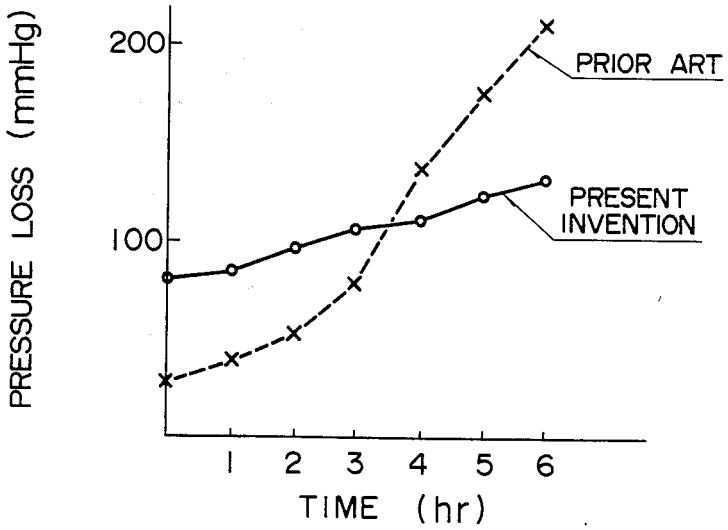
FIG. 6 is a graph showing test data in respect of pressure loss relative to time obtained from filters according to present invention and the prior art.
Figure 7:
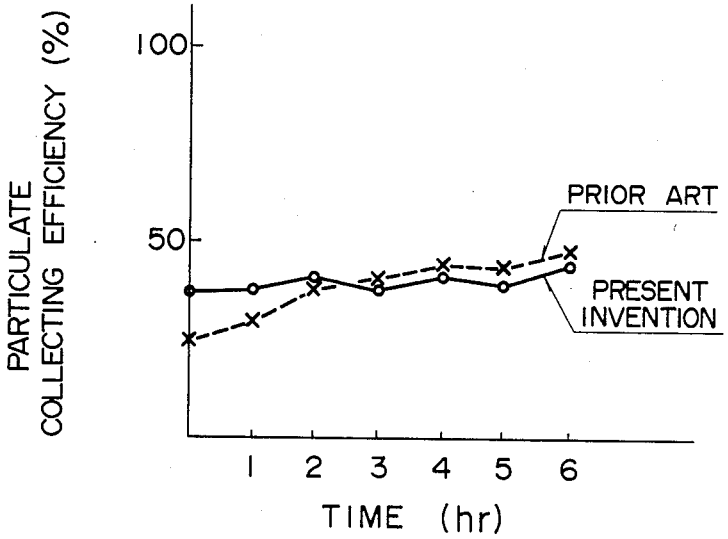
FIG. 7 is a graph showing test data concerning particulate collecting efficiency relative to time obtained from filters according to the present invention and the prior art.

Due to the change of the carbon particle collecting mechanism, the Diesel exhaust particulate collecting efficiency and pressure loss of the prior art ceramic filter of honeycomb type are varied as shown by broken lines in the graphs shown in FIGS. 6 and 7. It will be seen that the pressure loss and the particulate collecting efficiency are both at lower levels in the initial stage of the particulate collecting operation of the filter. This is because the particulate collection relies upon the above-mentioned impingement function in the initial stage. However, the pressure loss is sharply increased and the particulate collecting efficiency is also increased after the lapse of a certain time period from the commencement of the filter operation.

In the honeycomb type of porous ceramic filter having three dimensional porous ceramic network structure, the total of the inner peripheral surface areas of the inlet passags (13) is greatly less than that of such a honeycomb filter as is disclosed in U.S. Pat. No. 4,329,162, so that, if the filter is operated to remove particles relying upon the filtration function of the inner peripheral surfaces of the inlet passages (13), the pressure loss will be sharply increased in a short period of time to a level at which the filter is no longer usable. In the case where the filter is used as one for collecting Diesel exhaust particulates, increase in the pressure loss of the filter will cause a serious problem of increase in the back pressure to the engine and, thus, should be limited to a minimum level.

This requirement is met by the ceramic filter according to the present invention wherein the collection of carbon particles is effected solely by the above-mentioned particulate impingement function which lasts from the commencement of the carbon particulate collecting operation of the filter to the incineration of the carbon particulates thus collected on the filter.

In the prior art honeycomb type ceramic filter having three dimensional porous network structure, the thickness of each internal wall is designed to be uniform in the widthwise direction so that the gas entering the inlet passage can pass along substantially the same lengths of passages in the wall into the outlet passages. For this purpose, the cross-sectional configurations of the inlet and outlet passages in the prior art ceramic filter are square, rectangular or diamond shapes or combinations thereof. Because of this internal wall structure of the prior art ceramic filter, the gaseous pressure in the inlet passages acts perpendicularly to the surfaces of the internal walls so that the gases pass through each internal wall in a direction substantially perpendicular to the wall surface. Accordingly, although a part of the gases is dispersed due to the three dimensional porous ceramic network structure in the wall, the major parts of the gases move along substantially the same lengths of paths in the porous wall into an associated outlet passage.

It has been confirmed through test researches that gases hardly pass through the intersections (12*c*) of internal walls (12). In other words, the porous ceramic material in each intersection (12*c*) has been found not to be operative to collect carbon particulates. In a honeycomb ceramic filter structure having internal walls each of 3–5 mm in thickness, the total of the volumes of the intersections (12*c*) of the internal walls has been found to amount almost to 30% of the volume of the whole ceramic filter structure.

The ceramic structure according to the present invention has a lattice pattern which is different from those of the prior art structures to assure that each internal wall 12 disposed between an inlet passage 13 and an adjacent outlet passage 15 has a thickness which is varied widthwise to facilitate dispersion of gases during their passage through the wall and to increase the useful and effective area of the ceramic structure. In other words, the present invention increases that area of the ceramic structure which is useful and effective to collect carbon particulates.

More specifically, with the lattice pattern in the ceramic filter according to the present invention, the pressure of gases introduced into each of inlet passages 13 in the filter 4 acts perpendicularly against the inner peripheral surface of the inlet passage. Thus, the gases are dispersed in each of the internal walls toward the intersections 12*c* and pass zigzag through the ceramic material along increased lengths of paths and finally into an associated outlet passage 15.

It is to be noted that, when the collection of carbon particulates has been proceeded for a certain time period and the pores 14 in the thinner central zone 12*b* of a wall 12 have been substantially filled with carbon particulates with a resultant increase in the pressure loss in this localized zone of the internal wall 12, the gases are then allowed to pass selectively through the thicker zones 12*a* where the pores 14 have not yet been filled with carbon particulates, whereby the gases can move along paths of increased lengths in the thicker zones 12*a* into an adjacent outlet passage 15.

For the above reason, the ceramic filter according to the present invention provides a greatly increased area of porous ceramic structure effective to allow gases to pass. It has been confirmed through test researches that carbon particulates are collected in substantially the entire areas of the internal walls 12 and that the total volume of the ceramic material which does not play a part in collecting carbon particulates is as small as 5% of the total volume of the ceramic material in the filter.

The improvement according to the present invention over the prior art can be seen in FIGS. 6 and 7 which graphically illustrate test data concerning pressure loss relative to time and particulate collecting efficiency relative to time obtained from ceramic filters of the present invention and of the prior art. In the ceramic filter according to the present invention, the pressure loss in the initial stage of filter operation is higher than that of the prior art. This is because the paths of movements of gases in the walls are increased due to dispersion of gases with a resultant increase in the number of impingements of the gases upon three dimensinal ceramic network structure in the walls. However, the increase with time in the pressure loss is linear and at a low rate. This is because the increase in the volume of the ceramic material effective to collect carbon particles facilitates uniform collection of carbon particles in widened areas in the ceramic internal walls 12 with a result that the clogging of the pores in the porous internal ceramic walls in the filter hardly occur to prevent the particulate collecting mechanism from being changed from the particulate impingement function to the wall surface filtration function.

The particulate collecting efficiency of the ceramic filter according to the present invention is also higher than that obtainable from the particulate impingement-collection areas of the prior art ceramic filter and is at a substantially fixed level irrespective of the lapse of time. This is also because the paths of movements of gases in the internal ceramic walls are increased with a resultant increase in the number of impingements of the gases against the ceramic network in the walls.

Figure 8A:
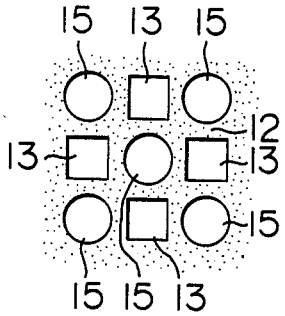
FIGS. 8A–8C are similar to FIG. 3 but show other combinations of the cross-sectional shapes of the inlet and outlet passages in ceramic filters.
Figure 8B:
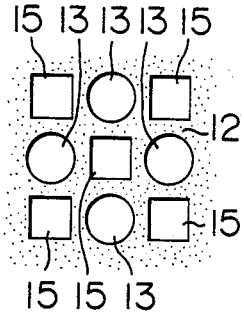
Figure 8C:
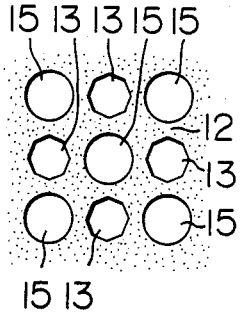

FIGS. 8A to 8C show modifications of the passage configurations. The modification shown in FIG. 8A comprises a combination of square inlet passages 13 with circular outlet passages 15, the modification shown in FIG. 8B comprising a combination of circular inlet passages 13 with square outlet passages 15 and the modification shown in FIG. 8C comprising a combination of octagonal inlet passages 13 with circular outlet passages 15. It will be apparant to those in the art that the internal wall 12 between an inlet passage 13 and an adjacent outlet passage 15 in each of the combinations shown in FIGS. 8A–8C has a non-uniform thickness which is minimum in the central zone and increases to each intersection of the wall with three other internal walls 12. Accordingly, each of the embodiments shown in FIGS. 8A–8C provides a particulate collecting operation substantially identical or similar to the particulate collecting operation described above.

Figure 9:
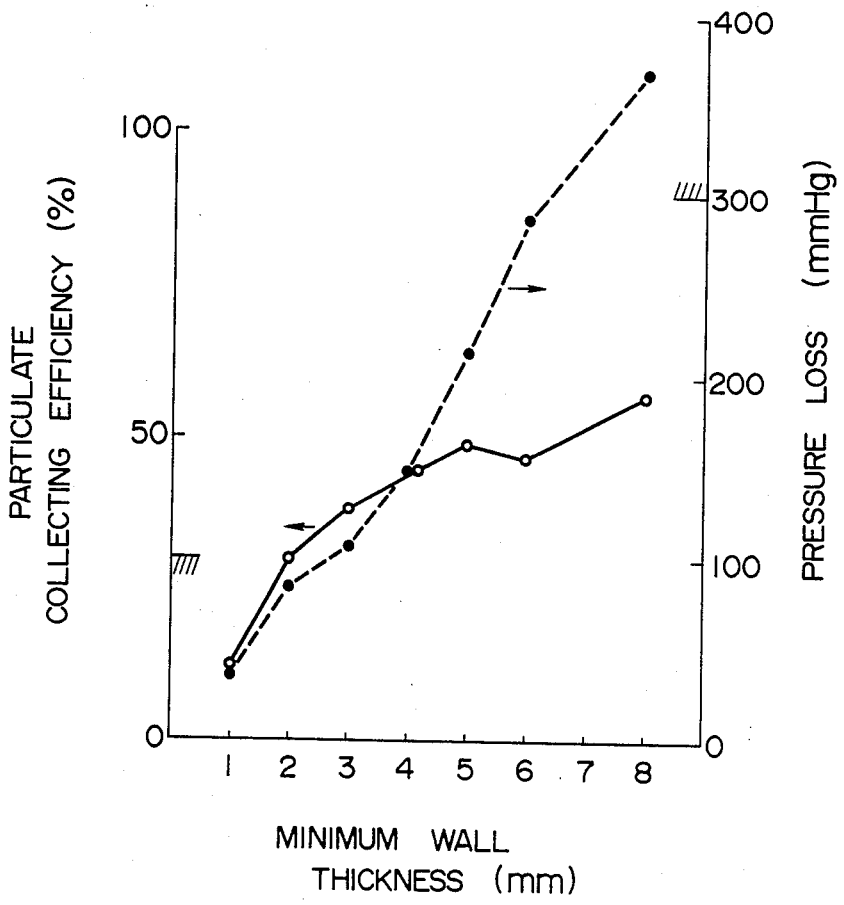
FIG. 9 is a graph showing test data concerning particulate collecting efficiency and minimum wall thickness and pressure loss relative to minimum wall thickness.

FIG. 9 graphically illustrates the result of an operation test of ceramic filters concerning the particulate collecting efficiency relative to time (solid lines) and pressure loss relative to the minimum wall thickness (dash lines). Each of the filters was of 1.6 liter in volume, had an average of 40 pores per inch and inlet and outlet passages both of circular sections each 3 mm in diameter. Each filter was associated with a 2.2 liter engine which was operated at 2,000 r.p.m. with a load of 6 kgm. The particulate collecting efficiency shown is a mean value obtained from filter operation for three hours, while the pressure loss was measured at the end of the three-hour filter operation. It has been found through the test that, in order for the filter to provide the necessary minimum particulate collecting efficiency and the maximum pressure loss allowable from the view point of the effect on the engine operation, the minimum thickness of each internal wall of the filter should range from 2 to 6 mm.

Figure 10:
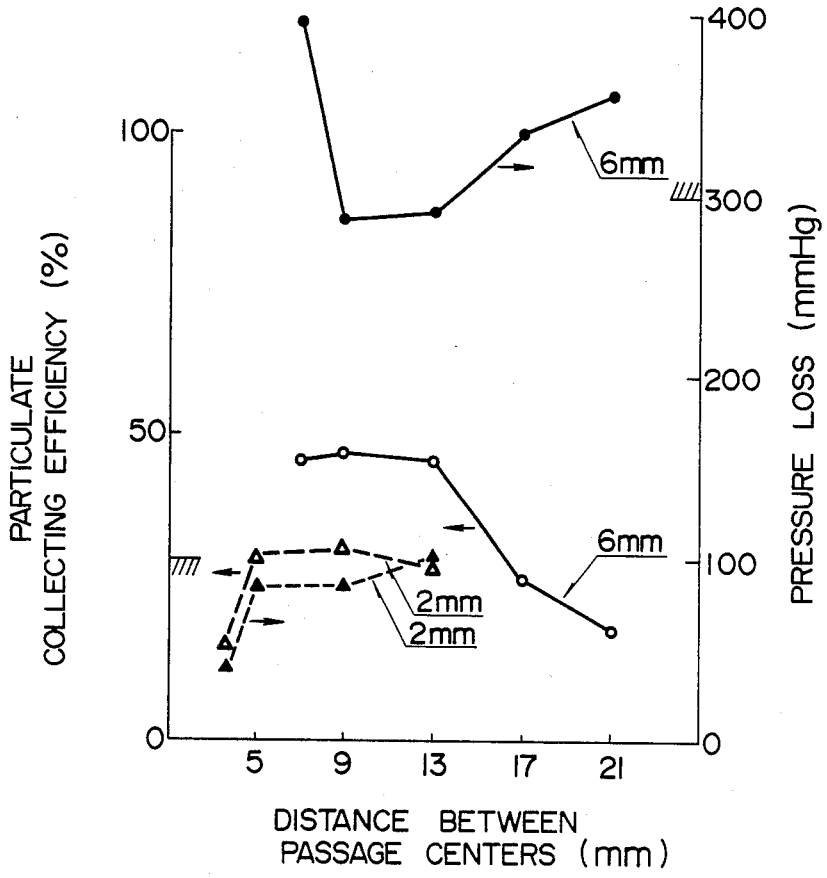
FIG. 10 is a graph showing test data concerning particulate collecting efficiency relative to distance between passage centers and pressure loss relative to passage center distance.

FIG. 10 graphically shows the results of tests concerning particulate collecting efficiency relative to distance between passage centers and pressure loss relative to passage center distance. The small circles and dots shown indicate, respectively, the particulate collecting efficiencies and pressure losses obtained from ceramic filters having porous internal walls each of 6 mm in thickness, while the open and closed triangles shown indicate, respectively, the particulate collecting efficiencies and pressure losses obtained from ceramic filters having porous internal walls each of 2 mm in thickness. It will be seen that, even for the same minimum wall thickness of 6 mm, and for filters having greater distances between centers of the passages, the increase in the distance between an inlet passage and an adjacent outlet passage results in the increase in the lengths of paths of movements of carbon particulates from the inlet passage through the wall into the outlet passage and thus results in the increase in the areas of the ceramic material which are not effective to collect the carbon particles, whereby the particulate collecting efficiency is lowered and the pressure loss is increased. To the contrary, for filters having internal walls of 2 mm thickness and having smaller distances between passage centers, the number of impingements of carbon particles against three dimensional ceramic network in the internal walls is reduced with resultant decrease in the particulate collecting efficiency and also in the pressure loss. From these view points, the distance between the center of an inlet passage and the center of an adjacent outlet passage should range from 5 to 15 mm.

Figure 11A:
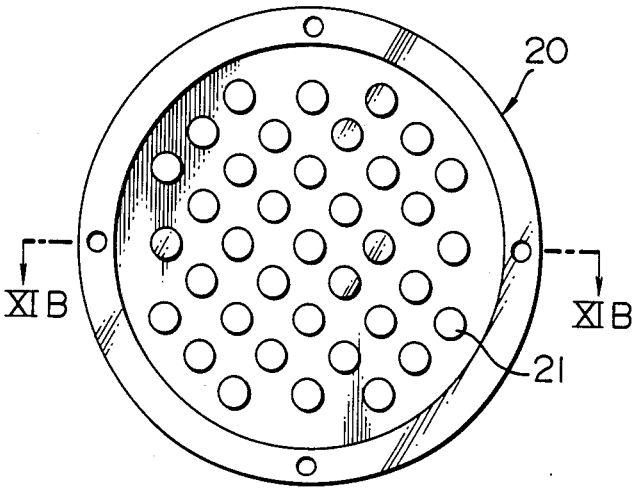
FIGS. 11A and 11B are top plan view and vertical sectional view, respectively, of a mold half.
Figure 11B:
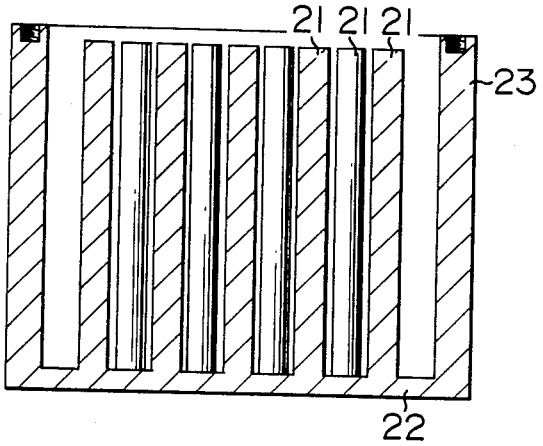
Figure 12A:
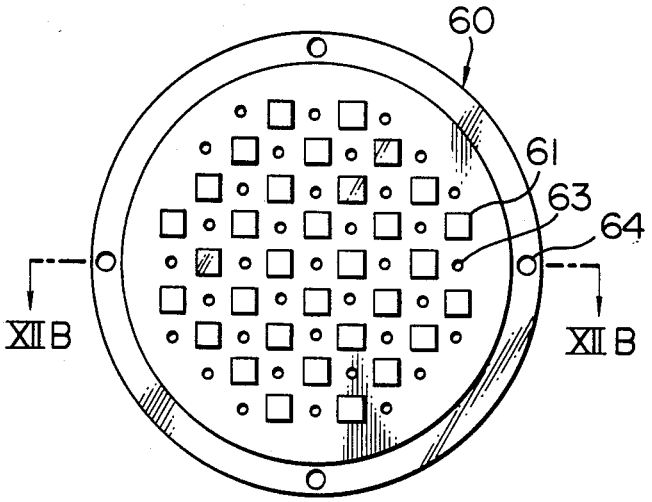
FIGS. 12A and 12B are top plan view and vertical sectional view, respectively, of another mold half.
Figure 12B:
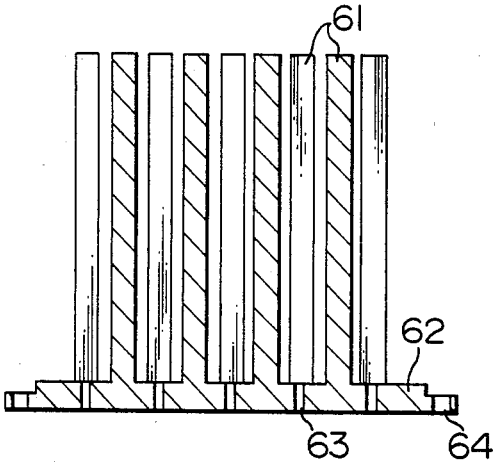
Figure 13:
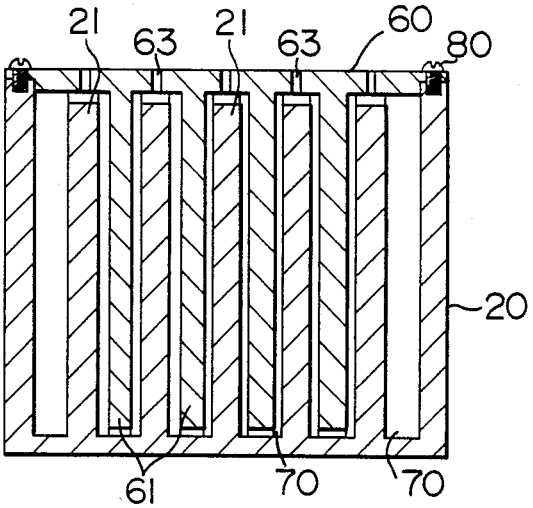
FIG. 13 is a vertical sectional view of a mold formed by the mold halves assembled and secured together.

Method and apparatus for producing the carbon filters of the embodiments shown in FIGS. 8A and 8C will be described with reference to FIGS. 11A through 13. FIGS. 11A and 11B illustrate a first mold half 20 while FIGS. 12A and 12B show a second mold half 60. The mold half 20 includes a plurality of cylindrical parallel posts 21 secured at their bottom ends to a circular bottom 22 of a cylindrical peripheral wall 23. The posts 21 are arranged in square lattice pattern and spaced from each other at substantially the same intervals. The second mold half 60 comprises a plurality of square parallel posts 61 secured at their one ends to a circular base 62. The posts 61 are arranged such that, when the first and second mold halves 20 and 60 are assembled in position as shown in FIG. 13, the posts 21 and 61 are interlaced with each other with spaces 70 defined therebetween. Communication apertures 63 are formed in the base 62 in positions to be communicated with the spaces 70 when the mold halves 20 and 60 are assembled. Screw holes 64 are formed in the base 62 along the outer peripheral edge thereof to accommodate screws 80 used to detachably secure the mold halves together. It will be noted that the spaces 70 are laterally communicated with each other to form a mold cavity which is complementary in cross-section to honeycomb structure.

A releasing agent is applied to the surfaces of the mold halves 20 and 60 before they are assembled as shown in FIG. 13. A quantity of emulsion formed by a uniform mixture of 100 parts of polyol and from 25 to 35 parts of isocyanate is poured into the mold cavity through selected every other aperture 63. Air is discharged from the mold cavity through the other apertures 63. The emulsion is caused to foam in the honeycomb mold cavity and then heated at 120° for 20 to 60 minutes to cure the urethane foam structure in the mold cavity. The mold halves are then disassembled to release the urethane foam structure.

The urethane foam structure has closed cells. So as to break the closed cells, the urethane foam structure is placed in a closed container. Combustible gas and air or oxygen are introduced into the container to form a combustible gaseous mixture which is then ignited by spark ignition to cause an explosion in the container whereby the closed cells are broken by the explosion. Alternatively, the urethane foam structure removed from the mold may be dipped into a solution of a strong alkaline material such as sodium hydroxide to deteriorate the walls of the closed cells until the material of the cell walls is dissolved into the solution.

The urethane foam structure having the thus broken cells is then dipped into a ceramics slurry formed by a mixture of 100 parts of powder which includs MgO, $Al_2O_3$ and $SiO_2$ and which become cordierite composition upon combustion, 60 to 100 parts of water and 6 to 10 parts of polyvinyl alcohol. Excessive slurry is then removed from the urethane foam structure by centrifugal operation, for example, and, thereafter, the slurry is dried at 100° to 200° C. The dipping and drying steps are repeated several times.

The slurry-impregnated urethane foam structure is then heated at 1300°–1470° C. for 2–6 hours to obtain a honeycomb type porous ceramic structure having interlaced internal porous ceramic walls 12 defining therebetween inlet passages 13 of circular cross-sections and outlet passages 15 of square cross-sections, as shown in Fig. 8B.

The described method and apparatus may be modified as follows:

(1) The posts 61 of the second mold half 60 may be of other shapes to provide other shapes of the outlet passages 15;

(2) The combination of the cross-sectional shapes of the posts 21 and 61 of the first and second mold halves can be varied to provide various other cross-sectional shapes of the inlet and outlet passages which provide ceramic internal wall structures required to achieve the intended filter operation;

(3) The organic composition foamed in the cavity 70 is not limited to urethane foam material and may alternatively be other foamable materials;

(4) The material of the ceramic filter 4 is not limited to the cordierite composition and may alternatively be other ceramic materials;

(5) The method of forming the foamed urethane structure is not limited to the described method and may alternatively include steps of allowing a foamable urethane to foam in a free space to form a bulk type foamed structure, applying to the thus foamed structure a thermal action by means of a wire type heater or sheath type heater or laser beams to obtain a formed urethane structure having desired outer and inner profiles; and (6) A bulk type porous ceramic structure having a three dimensional porous network structure may be prepared first and then worked by a physical force such as by drilling to form the inlet and outlet passages.

What is claimed is:

1. A filter element comprising a ceramic monolith honeycomb structure having inlet and outlet end walls and a plurality of interlaced porous internal walls defining a plurality of substantially parallel inlet passages extending between said end walls and adjacent to a plurality of substantially parallel outlet passages extending between said end walls, said inlet passages being open in said inlet end wall and closed by said outlet end wall, said outlet passages being closed by said inlet end wall and open in said outlet end wall, each of said internal walls having pores therein to permit gases to flow from an inlet passage through the pores in said internal walls to an adjacent outlet passage, wherein each of said internal walls has a thickness which varies widthwise of each of the internal walls, each of the internal walls including a central zone disposed substantially centrally of the width of each of the internal walls, the thickness of each of the internal walls being minimum in the central zone and increasing toward the lateral sides of the width of each of the internal walls.

2. A filter element according to claim 1, wherein each of said porous internal walls has a three dimensional ceramic network structure.

3. A filter element according to claim 1, wherein the minimum wall thickness in the central zone of each of the internal walls ranges from 2 to 6 mm and wherein the distance between the center of one of said inlet passages and the center of an adjacent outlet passage ranges from 5 to 15 mm.

* * * * *